US005167138A

United States Patent [19]

Sinha et al.

[11] Patent Number: 5,167,138

[45] Date of Patent: Dec. 1, 1992

[54] CONFORM EXTRUSION PROCESS AND APPARATUS

[75] Inventors: Uday K. Sinha; Thomas N. Wilson, both of Carrollton, Ga.; John Cassimus, Osceola, Ark.

[73] Assignee: Southwire Company, Carrollton, Ga.

[21] Appl. No.: 469,119

[22] Filed: Jan. 24, 1990

Related U.S. Application Data

[63] Continuation of Ser. No. 140,165, Dec. 31, 1987, abandoned.

[51] Int. Cl.[5] ..... B21C 29/00; B21C 29/02

[52] U.S. Cl. ..... 72/262; 72/253.1

[58] Field of Search ..... 72/253.1, 262

[56] References Cited

U.S. PATENT DOCUMENTS

| | | | |
|---|---|---|---|
| 2,105,083 | 1/1938 | Kagi et al. | 72/253.1 |
| 2,161,570 | 6/1939 | Harris | 72/253.1 |
| 3,364,707 | 1/1968 | Foerster | 72/253.1 |
| 3,514,986 | 6/1970 | Habscheidt et al. | 72/253.1 |
| 3,765,216 | 10/1973 | Green | 72/262 |
| 4,242,368 | 12/1980 | Nagai et al. | 72/262 |
| 4,277,968 | 7/1981 | Pardoe | 72/262 |
| 4,598,567 | 7/1986 | Backus | 72/262 |

FOREIGN PATENT DOCUMENTS

| | | | |
|---|---|---|---|
| 54-47856 | 4/1979 | Japan | 72/262 |
| 57-159213 | 10/1982 | Japan | 72/262 |
| 58-107243 | 6/1983 | Japan | 72/262 |
| 59-223113 | 12/1984 | Japan | 72/262 |
| 60-6220 | 1/1985 | Japan | 72/262 |
| 2177958 | 2/1987 | United Kingdom | 72/262 |

*Primary Examiner*—John Sipos
*Assistant Examiner*—Donald M. Gurley
*Attorney, Agent, or Firm*—Stanley L. Tate; James W. Wallis, Jr.; George C. Myers, Jr.

[57] ABSTRACT

Apparatus for continuously extruding material includes a moving member and a stationary member forming a passageway therebetween for frictional feeding of the material to be extruded under pressure into the passageway. An abutment in the passageway forms a barrier to the material being fed therein, whereby the forces on the material heat it and cause it to yield. The heated material flows into an extrusion chamber adjacent to the abutment and is extruded from a die in a wall of the chamber. A cooling system in heat exchanging relationship with the chamber in proximity to the die maintains the material in that region of the chamber at a substantially uniform temperature to provide uniformity of grain size in the extruded product. A further cooling system at the point of egress cools the extruded product immediately as it exits from the die to inhibit secondary recrystallization.

6 Claims, 2 Drawing Sheets

CONFORM EXTRUSION PROCESS AND APPARATUS

This is a continuation of application Ser. No. 140,165, filed on Dec. 31, 1987, now abandoned.

FIELD OF THE INVENTION

The present invention relates generally to extrusion processes and apparatus, and more particularly to the type of extrusion apparatus generally known as conform machines designed to permit continuous extrusion of a feedstock material into various shapes and sizes.

DESCRIPTION OF THE PRIOR ART

In the typical conform extrusion machine, solid feedstock such as an aluminum rod or other solid or powdered material to be extruded is fed in an unheated state into the machine along a rotating wheel. The wheel has an endless groove at its periphery to receive the feedstock. A portion of the circumference of the wheel, typically about one-quarter of the length thereof, is maintained in close contact with a fixed heavy metal block known as an extrusion shoe. At the end of the contacting portion, a blocking abutment that enters the groove obstructs the path of the feedstock, preventing it from being carried further along the groove in the rotating wheel. As the extrusion material is pushed against the abutment by the frictional force exerted by the continuously rotating wheel, sufficient force is produced to extrude the material through a die retained at the end of a chamber in the shoe adjacent to the blocking abutment.

The advantages of the conform extrusion machine over heretofore conventional extrusion apparatus include the provision of a theoretically continuous extruding process, with attendant simplification of subsequent handling techniques and elimination of billet discards, and the use of cold solid or powdered feedstock with avoidance of any need to preheat the material prior to extrusion thereof. Examples of prior art conform extrusion apparatus of the aforementioned type are described in U.S. Pat. Nos. 3,765,216 to Green and 4,055,979 to Hunter et al.

Considerable heat is generated by the enormous frictional resistance and resulting axial stress encountered by the feedstock as it is fed along the groove by the rotating wheel, as a consequence of the close contact of the latter with the extrusion shoe. The frictional force and attendant heat cause the feedstock to yield and flow through the die. In a typical process, the extruded product may be fed into a water quench tank located some five to ten feet from the exit die. It has been found that such prior art conform machines produce extruded products having non-uniform grain size and large surface grains which cause "orange peel" of the product when it is subjected to mechanical bending or other similar high stress working operations. Accordingly, it is a principal object of the present invention to provide a conform extrusion machine for producing extruded products with uniform small grain structure and improved mechanical properties.

In a typical conform extrusion process, an expansion chamber may be provided in the extrusion shoe, located adjacent to the blocking abutment and upstream of the die, to allow extrusion of product of larger cross-section than the feed material. The shearing forces on the feed material are higher along the extrusion shoe, which is fixed relative to the moving material, than along the grooved rotating wheel with which the material is moved. As a result, the temperature of the feed material is higher in the region adjacent to the shoe than in the region adjacent to the rotating wheel. In the conformed product (i.e., the extruded product), the portion subjected to the higher temperature during the extrusion process has a larger grain size. As a result of the orientation of the movable and stationary components of the conform machine, the region of the feed material adjacent the stationary shoe experiences higher temperatures and, thus, the corresponding portion of the conform product has larger grains than other portions of the product as it leaves the die.

The surface of the conform product recrystallizes more rapidly than the product interior because of the hardening process. Additionally, because of the high exit temperature of the conform product as it leaves the die, it undergoes a spontaneous secondary recrystallization along the edges of its surface, with consequent further grain growth. The resulting product suffers seriously inconsistent grain size and attendant structural deficiencies.

Therefore, a further object of the present invention is to provide an improved conform machine employing special cooling systems to enhance the structural properties of the final product.

It is a more specific object of the invention to provide a cooling system for conform extrusion apparatus which allows the extrusion process to be carried out at a preselected desired temperature and which maintains the material in the extrusion chamber at a uniform temperature.

Another object of the present invention is to provide a conform machine with plural cooling systems for maintaining a preset extruding temperature and for inhibiting secondary recrystallization of the product.

SUMMARY OF THE INVENTION

The present invention resides, in one aspect, in a conform extrusion apparatus employing a first cooling system for maintaining a desired temperature in the extrusion chamber of the apparatus. This first cooling system provides means at both sides of the extrusion chamber for sensing the temperature thereat, a coolant supply system to both sides of the chamber, and control means responsive to changes in the temperature at either side relative to a predetermined extrusion chamber temperature for varying the flow of coolant to each side respectively. Thus, there are expected temperature values at a plurality of points within the extrusion chamber and a predetermined extrusion chamber temperature, resulting in several possible temperature differences. In this manner, the temperature of the material is maintained substantially uniform throughout the extrusion chamber, to produce a conform product having a substantially uniform small grain structure and consequent improved mechanical properties.

According to another aspect of the invention, a second cooling system is provided to cool the conform product as it exits the die and thereby inhibit secondary recrystallization and grain growth at the surface of the product.

In conventional extrusion processes which do not use the conform technique, it is customary to provide cooling within the die. However, the heating problem in the conform process is different from that encountered in the conventional extrusion process and requires a vastly different solution which takes into account the presence of localized hot spots contributing to the different grain sizes in the final product. It has been proposed in the past to use various types of cooling systems in the type of conform extrusion apparatus which uses entry feed material in molten rather than solid or powdered form, but in those instances the proposed cooling has been for purposes of solidifying the molten material. Examples of such techniques are found in U.S. Pat. No. 4,393,917 to Fuchs, Jr., and European patent application publication No. EP 0110653. In contrast to the prior art proposals, the present invention provides a cooling system for conform extrusion apparatus which maintains uniform temperature of the extrudable material at both sides of the extrusion chamber to prevent non-uniform grain sizes in the extruded product.

BRIEF DESCRIPTION OF THE DRAWINGS

The above and still further objects, features, and attendant advantages of the present invention will become apparent from a consideration of the following detailed description of a preferred embodiment thereof, taken in conjunction with the accompanying drawings in which.

DESCRIPTION OF THE PREFERRED EMBODIMENT

Figure 1:
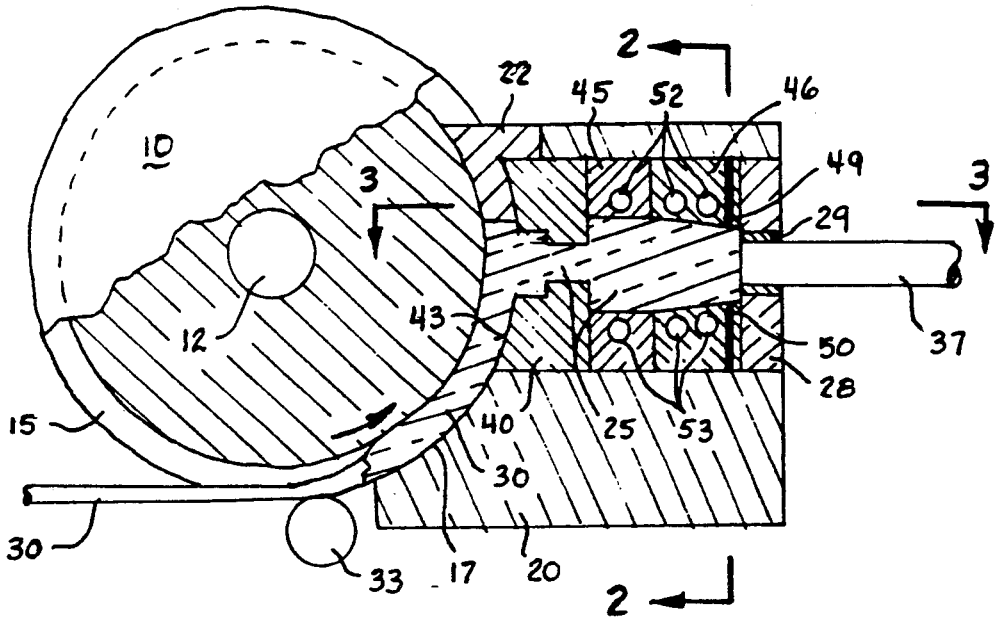
FIG. 1 is a partial view of the sectional side elevation of a conform extrusion apparatus including a first cooling system according to a preferred embodiment of the invention.
Figure 2:
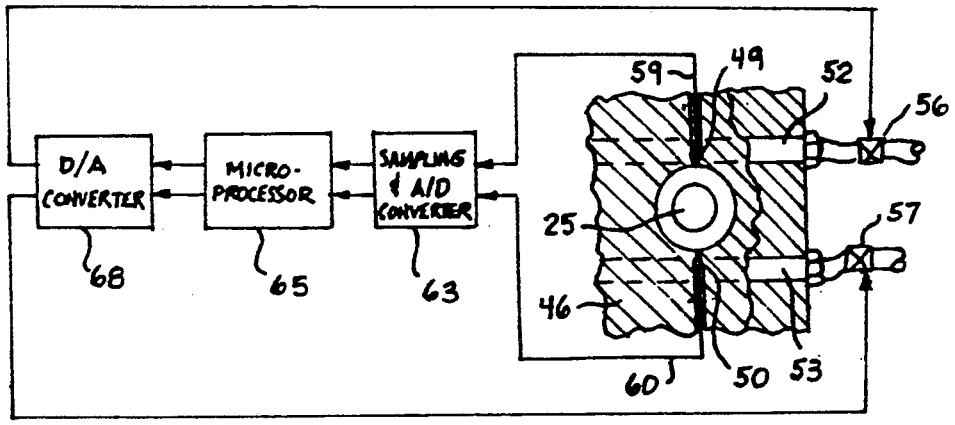
FIG. 2 is a partial view of a sectional end elevation of the apparatus of FIG. 1 taken along the line 2—2, and schematically illustrating the control system for the cooling system therein.

Referring now to FIGS. 1 and 2, an apparatus for continuously extruding material into a desired conform product includes a wheel 10 mounted for rotation on a shaft 12. Wheel 10 has an endless channel or groove 15 suitably formed in its circumferential edge 17. The wheel 10 rotates counterclockwise in close proximity to an extrusion shoe 20 which remains stationary relative to the wheel. A channel blocking abutment 22 is affixed to shoe 20 and enters the channel 15 in close proximity to the walls thereof, so that the wheel is free to rotate but a barrier is formed by abutment 22 to anything that may be carried in that passageway. The extrusion shoe 20 includes an extrusion chamber 25 disposed adjacent to the blocking abutment 22. A die block 28 at the end of the extrusion chamber forms a wall of the chamber and retains a die 29 therein to permit material to be extruded therethrough into a desired shape.

Thus far, everything which has been described is completely conventional structure in conform extrusion machines of the prior art. Such conventional structure is shown and described in U.S. Pat. No. 3,765,216 to Green, the teaching of which is hereby incorporated by reference. In operation, a solid feedstock or feed material 30, which may be an aluminum rod, for example, of a size adequate to be received within channel 15 is fed into the channel. It will, of course, be appreciated by those skilled in the art that the orientation of the extrusion shoe 20 and abutment 22 may be inverted such that the feed material 30 is fed into the channel 15 from above the wheel 10 which would then be rotated clockwise.

The feed material 30 is upset into the channel 15 with the assistance of a coining roll 33 such that it frictionally engages the walls of the channel 15 as the wheel 10 rotates in a counterclockwise direction, as viewed in FIG. 1. The material eventually encounters the blocking abutment 22 in channel 15, typically located about one-quarter of the circumference of the wheel from the entry point for the material 30. The abutment 22 stops the movement of material and continued feed of the material causes it to fill the channel 15 until the material engages the stationary surface of the shoe 20 confronting the channel 15. Under the frictional forces and the pressure exerted on the feed material, and the accompanying axial stress set up in the material it will begin to yield at a point which depends on the heat generated by the process and the yielding strength of the particular material used.

The yielding material commences to flow and is thereby forced into the extrusion chamber 25 and ultimately extruded through the die 29, to produce the desired conform product 37. If desired, an expansion chamber may be used with an appropriately larger die, to permit extrusion by the conform apparatus. Viewing the orientation of the various components of the apparatus described thus far, which is a typical orientation for conform machines of the prior art, the feed material experiences greater frictional force along the stationary member side of the machine; that is, on the side toward the extrusion shoe 20. The portion of the material encountering this higher frictional force is heated to a higher temperature than that portion of the material subjected to lower frictional force. Accordingly, in the illustrated apparatus, the flowable material in the lower part of the extrusion chamber is typically substantially hotter than that in the upper part of the chamber. As a result, the grain size of the extruded product is irregular, with the larger grains at the lower part of the product relative to the size of the grains in the upper part, and with a concomitant deleterious effect on the mechanical properties of the final extruded product. Similarly, if the orientation of the shoe is the reverse of that shown in the drawings, i.e., with the stationary shoe above the abutment, the larger grains will be at the upper part of the product.

Figure 3:
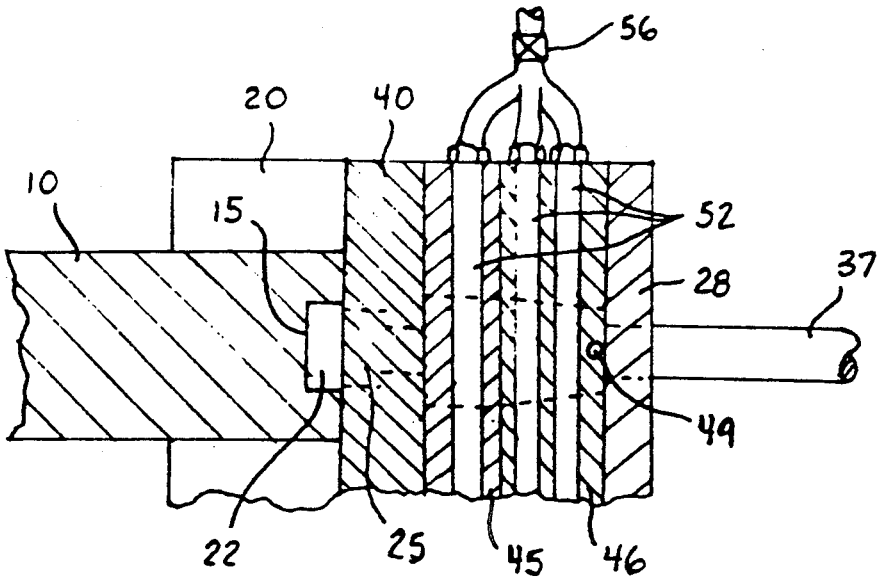
FIG. 3 is a partial sectional view of the apparatus of FIG. 1 taken along the line 3—3.

According to a preferred embodiment of the present invention, the conform extrusion apparatus is provided with a system for controlling the temperature of the flowable material in the extrusion chamber to remove the undesired hot spots, in the manner shown in FIGS. 1, 2 and 3. First, it should be noted that although the extrusion chamber 25 may be integrally formed in the extrusion shoe 20 by machining the latter, it may alternatively be provided in a separate component or components which are fitted into or on the shoe, and which maintain the above-described relationship of the chamber to the blocking abutment 22 in the channel 15.

As shown most clearly in FIG. 1, such a component is an expansion chamber member 40 having an arcuate surface 43 conforming to an arc at the circumference of rotatable wheel 10 and confronting the channeled edge of the wheel when member 40 is fastened to the shoe 20. The extrusion chamber (expansion chamber) 25 is formed in part in chamber member 40 and in further part in a pair of feeder blocks 45,46 which are also fitted and secured in the shoe. That portion of chamber 25 provided by the openings in the feeder blocks 45,46 may be larger than the chamber portion in member 40, and the portion in feeder block 46 may be tapered down toward the die block 28 forming the end wall of the extrusion chamber.

Thermocouples 49 and 50 are housed at or near the longitudinal surface of chamber 25 in feeder block 46, preferably close to the die block 28. Each of the thermocouples is formed in conventional manner from a pair of dissimilar thermoelectric materials, and each generates an electrical signal representative of the temperature at the junction of the dissimilar materials. The thermocouples are electrically insulated from the feeder block and from each other, and have their respective junctions positioned as close as practicable to the surface of chamber 25 to detect the temperature of feed material in the chamber or of that portion of the feeder block immediately adjacent to the chamber. The location of the thermocouples next to the die block assures that the temperature of the material in the extrusion chamber is sensed at a point or points reasonably close to the point from which the material is extruded from the chamber to form the desired conform product 37.

In the preferred embodiment, thermocouple 49 is positioned at the upper side of the extrusion chamber 25 and thermocouple 50 is positioned at the lower side of the chamber 25 to sense the temperature of regions of the material which are, in the orientation shown in the drawings, typically at the lowest and highest temperatures, respectively, in the selected portion of the chamber, for reasons discussed above. Although only two thermocouples are shown in the embodiment of FIGS. 1 and 2, it will be understood that additional thermocouples may be employed at spaced locations about portions of or the entire periphery of the chamber close to the die block 28.

Feeder blocks 45,46 are provided with ducts or passageways 52 and 53 therethrough, respectively running adjacent to the upper and lower sides of chamber 25 so as to be in heat exchange relationship principally with those portions of the chamber. Each of the ducts is adapted to carry a coolant fluid therethrough, such as water or liquid nitrogen. Obviously, these examples of suitable coolant fluids are virtually opposite ends of the range of coolants which could be employed; in the case of liquid nitrogen, the handling and distribution requirements are more rigorous, albeit entirely conventional. Ducts 52 are joined together at a single inlet having an electrically controlled valve 56, such as a solenoid valve, to regulate the flow of coolant fluid therethrough. A corresponding but completely separate cooling system arrangement is provided for lower ducts 53 which are joined at a single inlet having an electrically controlled flow regulating valve 57. At the opposite ends of the upper and lower ducts, suitable conventional means (not shown) are provided for recirculating the coolant fluid back to the source thereof.

Each of the thermocouples 49, 50 is electrically connected via leads 59,60, respectively, to a sampling circuit and/or an analog/digital (A/D) converter 63 (FIG. 2) to properly condition the electrical signal outputs of the thermocouples, which are representative of the temperature values at the respective thermocouple junctions, for application to a microprocessor 65. Preferably, the microprocessor is adapted to compare the sensed temperature signal value from thermocouple 50 to the signal value deriving from thermocouple 49 and to null the difference by generating an output which is converted by D/A converter 68 to an analog signal for that purpose. Since the temperature of the material in one region (in this case, the lower region) of the extrusion chamber attributable to the conform extrusion process is almost invariably higher than the temperature of the material in the opposite region (in this case, the upper region) of the chamber, the analog control signal deriving from the microprocessor may be used to control the valve 57 to allow flow of the coolant fluid through ducts 53 until the temperature sensed by thermocouple 50 is reduced to the temperature sensed by thermocouple 49. If this preferred process of nulling the difference between the two temperature readings is chosen, it is possible to perform the nulling using only the one cooling system including ducts 53 and valve 57 and associated electronic control, because temperature reduction will be necessary only in the one (lower) region of the extrusion chamber.

Alternatively, a preselected temperature at which the material is to be extruded may be set into a memory associated with the microprocessor 65, and constitute the temperature which is to be maintained at both thermocouple locations. Such predetermined temperature will be selected to be always less than or equal to the actual anticipated temperature of material in the upper portion of the chamber attributable to the extrusion process alone (i.e., before cooling). In this alternative arrangement, separate upper and lower cooling systems are required. The microprocessor compares the sensed temperature at each thermocouple location to the predetermined temperature, and generates separate control signals which are applied via the converter 68 to the two valves 56,57 to regulate the flow of coolant fluid therethrough. Thereby, the temperatures of the upper and lower regions of the chamber are adjusted as necessary to bring them to predetermined temperature.

The extruded product 37 resulting from the provision of a substantially uniform temperature of material at the point of extrusion, according to the invention, has a considerably more uniform grain size throughout and consequent improved mechanical properties. Nevertheless, it has been found that the extruded product undergoes secondary recrystallization at and near its surface, attributable to the high exit temperature of the product. While this secondary recrystallization is not as extensive as occurs in conventional conform extrusion processes without the cooling system of the present invention, it does cause some grain growth in the affected region near the product surface. According to a further feature of the invention, a second system is provided for cooling the product as it is extruded from the die, to inhibit the secondary recrystallization.

Figure 4:
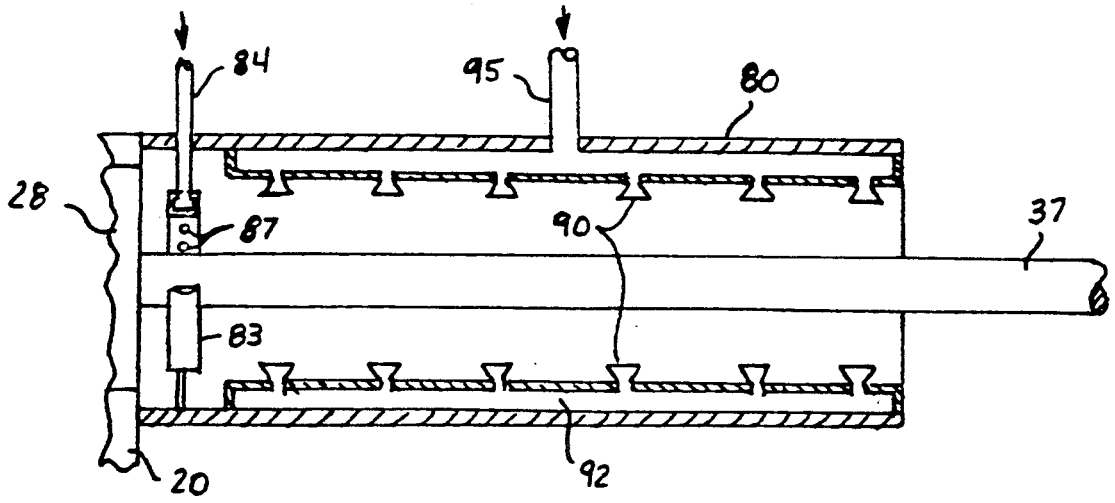
FIG. 4 is a sectional side elevational view of a second cooling system for the apparatus of FIGS. 1 and 2.

Referring to FIG. 4, the second cooling system includes a cylindrical member 80 positioned against the surface of the die block 28 or of the shoe 20 holding the die block. Member 80, which constitutes a backer plate, has a pair of cooling devices operatively associated therewith. One of these cooling devices is a ring conduit 83 supported internally in the member 80 to be in close proximity to the die block 28 when the member is assembled against the extrusion shoe (e.g., under hydraulic pressure). Conduit 83 is coupled to an inlet 84 to receive nitrogen gas or other suitable inert cooling gas, and to direct the inert gas onto the extruded product as it exits the die, from an array of aligned holes or nozzles 87 in the interior surface of the ring. This provides both cooling of the product surface and an inert atmosphere to inhibit oxidation of the product surface.

The second of the pair of cooling devices in the die exit cooling system includes an array of sprayheads 90 coupled to a reservoir 92 about the inner surface of member 80. The reservoir is connected to a pipe 95 for delivery of cooling water under pressure to the reservoir and the sprayheads, from which the water is sprayed directly onto the surface of the extruded product for rapid cooling thereof as the product exits the die 29. The latter cooling device is most effective for inhibiting the secondary recrystallization at the surface region of the product and the accompanying grain growth in that region. The gaseous streams produced by the ring conduit 83 also serve to prevent water spray from contacting the surface of the die, and thereby protect against spalling of the die. Although two alignments of sprayheads 90 are shown in FIG. 4, additional strings of sprayheads or different arrays thereof may be utilized depending on the size and shape of the extruded product. The exit cooling system comprising the inert gas and the water spray may be controlled in any conventional manner to be and remain operative throughout the extrusion of product through die 29.

Although certain preferred embodiments have been described herein, it will be apparent to those of ordinary skill in the field to which the invention pertains that variations and modifications of the described embodiments may be made without departing from the spirit and scope of the invention. Accordingly, it is intended that the invention be limited only to the extent required by the appended claims.

What is claimed is:

1. A conform continuous extrusion apparatus for producing an extruded conform product, comprising:

a) means for continuously advancing an extrusion material, said means for advancing including a continuously advancing channel;

b) a fixed member, cooperating with said means for advancing to define a material passageway, said fixed member including a blocking abutment in said channel at least partially closing said material passageway;

c) an extrusion chamber having an exit and an entrance communicating with said material passageway at said abutment;

d) an extrusion die covering said chamber exit;

e) cooling means for differential cooling of portion of said chamber, including:

i) means for delivering coolant to each of a plurality of points in heat exchanging relationship with said chamber, said points being related to respective portions of said chamber, said means for delivering further including a plurality of individual means for carrying coolant about said chamber, each of said carrying means comprising a coolant passageway, and a plurality of individual means for restricting coolant flow, each of said restriction means comprising a valve coupled to a respective one of said coolant passageways to restrict the flow of coolant therethrough, ii) means for sensing the temperature of the extrusion material at a plurality of preselected points about said chamber, and iii) means, responsive to a difference between the sensed temperature at any of said points and a selected temperature, for controlling the delivery of coolant by said delivery means to null said difference, and f) means for cooling the extruded conform product after it exits from said die such that secondary recrystallization of the extruded conform product is inhibited as it exits the die, which product cooling means comprised a first secondary cooling means, further including an additional means for secondary cooling of the extruded product immediately as it exits from said die, disposed between said die and said first secondary cooling means, wherein said additional secondary cooling means further comprises means for i) inert gaseous cooling of the conform product and for ii) isolating said die from coolant emitted by said first secondary cooling means.

2. Apparatus as in claim 1, further including an expansion chamber positioned ahead of said die and forming a part of said extrusion chamber, said cooling means being coupled to said expansion chamber.

3. Apparatus as in claim 2, said expansion chamber being formed of first and second feeder blocks which are fitted to and secured in said fixed member.

4. Apparatus as in claim 1, wherein said means for controlling delivery of coolant regulates the temperature of extrusion material in said extrusion chamber in proximity to said extrusion die.

5. Apparatus as in claim 1, wherein said chamber coolant is a liquid.

6. Apparatus as in claim 1, wherein said coolant is a gas.

* * * * *